US009316984B2

(12) United States Patent
Ryuzaki et al.

(10) Patent No.: US 9,316,984 B2
(45) Date of Patent: Apr. 19, 2016

(54) SEALING MEMBER, STORAGE MEMBER, AND IMAGE FORMING APPARATUS

(71) Applicant: FUJI XEROX CO., LTD., Tokyo (JP)

(72) Inventors: Teruyo Ryuzaki, Yokohama (JP); Yoshihiko Ichikawa, Yokohama (JP); Kokichi Kasai, Yokohama (JP); Koichi Kumeta, Yokohama (JP); Masahiro Mori, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/459,729

(22) Filed: Aug. 14, 2014

(65) Prior Publication Data

US 2015/0108711 A1 Apr. 23, 2015

(30) Foreign Application Priority Data

Oct. 22, 2013 (JP) ..... 2013-219132
Oct. 22, 2013 (JP) ..... 2013-219133
Oct. 22, 2013 (JP) ..... 2013-219134

(51) Int. Cl.
*G03G 15/00* (2006.01)
*B41J 29/13* (2006.01)
*G03G 21/16* (2006.01)

(52) U.S. Cl.
CPC ..... *G03G 15/6502* (2013.01); *B41J 29/13* (2013.01); *G03G 15/6552* (2013.01); *G03G 21/1623* (2013.01); *G03G 21/1633* (2013.01)

(58) Field of Classification Search
CPC ..... B65H 1/00; B65H 1/04; B65H 2405/10; B65H 2405/1134; B65H 2405/31; B65H 2405/32; E06B 7/232; E06B 7/231; B60J 10/08; B60J 10/0062; F25D 23/087; G03G 15/6502; G03G 21/1623; G03G 21/1633; G03G 15/6552; B41J 29/13
USPC ..... 271/162; 49/475.1, 482.1, 489.1, 496.1; 277/630, 634, 637, 638, 644, 650, 652, 277/925
See application file for complete search history.

(56) References Cited

U.S. PATENT DOCUMENTS 2,240,181 A * 4/1941 Fairbank ..... 296/199
2,700,197 A * 1/1955 Kesling ..... 49/479.1

(Continued)

FOREIGN PATENT DOCUMENTS

JP A-55-76299 11/1978
JP A-7-228204 8/1995

(Continued)

OTHER PUBLICATIONS

Feb. 4, 2014 Office Action issued in Japanese Application No. 2013-219132 (with translation).

(Continued)

*Primary Examiner* — David H Bollinger
(74) *Attorney, Agent, or Firm* — Oliff PLC

(57) ABSTRACT

It is a sealing member that seals a gap between one member and the other member, including: a mounting section that has a portion coming into contact with the other member; and an extension section that extends from a side of the mounting section to a side of the one member and is configured to approach the mounting section while coming into contact with the one member by receiving a force from the one member; and a recess that is provided between the mounting section and the extension section and is formed from a part of the mounting section to a part of the extension section, and is recessed from a surface of the mounting section on the side of the one member and a surface of the extension section on a side of the other member.

22 Claims, 8 Drawing Sheets

(56) References Cited

U.S. PATENT DOCUMENTS

| | | | | | |
|---|---|---|---|---|---|
| 2,793,070 | A | * | 5/1957 | Wernig | 296/76 |
| 3,276,167 | A | * | 10/1966 | Hirche et al. | 49/489.1 |
| 4,300,528 | A | * | 11/1981 | Slemmons | 126/545 |
| 4,419,844 | A | * | 12/1983 | Kreisfeld | 49/475.1 |
| 5,010,691 | A | * | 4/1991 | Takahashi | 49/482.1 |
| 5,145,163 | A | * | 9/1992 | Cowan et al. | 271/161 |
| 5,423,147 | A | | 6/1995 | Dupuy | |
| 5,475,946 | A | * | 12/1995 | Howe | 49/470 |
| 5,551,192 | A | * | 9/1996 | Avendano et al. | 49/484.1 |
| 6,260,305 | B1 | * | 7/2001 | Joyce | 49/496.1 |

FOREIGN PATENT DOCUMENTS

| | | |
|---|---|---|
| JP | A-8-199664 | 8/1996 |
| JP | A-2002-59127 | 2/2002 |
| JP | A-2002-71024 | 3/2002 |
| JP | A-2003-28357 | 1/2003 |
| JP | A-2006-182252 | 7/2006 |
| JP | A-2006-194971 | 7/2006 |
| JP | A-2008-7242 | 1/2008 |
| JP | A-2008-196514 | 8/2008 |
| JP | A-2011-47230 | 3/2011 |

OTHER PUBLICATIONS

Feb. 4, 2014 Office Action issued in Japanese Application No. 2013-219133 (with translation).

Feb. 12, 2014 Office Action issued in Japanese Application No. 2013-219134 (with translation).

Apr. 15, 2014 Office Action issued in Japanese Application No. 2013-219134 (with translation).

* cited by examiner

SEALING MEMBER, STORAGE MEMBER, AND IMAGE FORMING APPARATUS

CROSS-REFERENCE TO RELATED APPLICATIONS

This application is based on and claims priority under 35 USC 119 from Japanese Patent Application Nos. 2013-219132 filed on Oct. 22, 2013, 2013-219133 filed on Oct. 22, 2013, and 2013-219134 filed on Oct. 22, 2013.

BACKGROUND

Technical Field

The present invention relates to a sealing member, a storage member, and an image forming apparatus.

SUMMARY

According to an aspect of the invention, it is a sealing member that seals a gap between one member and the other member, including: a mounting section that has a portion coming into contact with the other member; an extension section that extends from a side of the mounting section to a side of the one member and is configured to approach the mounting section while coming into contact with the one member by receiving a force from the one member; and a recess that is provided between the mounting section and the extension section and is formed from a part of the mounting section to a part of the extension section, and is recessed from a surface of the mounting section on the side of the one member and a surface of the extension section on a side of the other member, wherein the recess is formed such that a cross-sectional shape thereof is an arc shape, and a thickness of a portion where the recess is formed is thinner than a that of a portion of the extension section where the recess is not formed.

BRIEF DESCRIPTION OF THE DRAWINGS

Exemplary embodiment(s) of the present invention will be described in detail based on the following figures, wherein.

DETAILED DESCRIPTION

Hereinafter, an embodiment of the invention will be described in detail with reference to the drawings.

Figure 1:
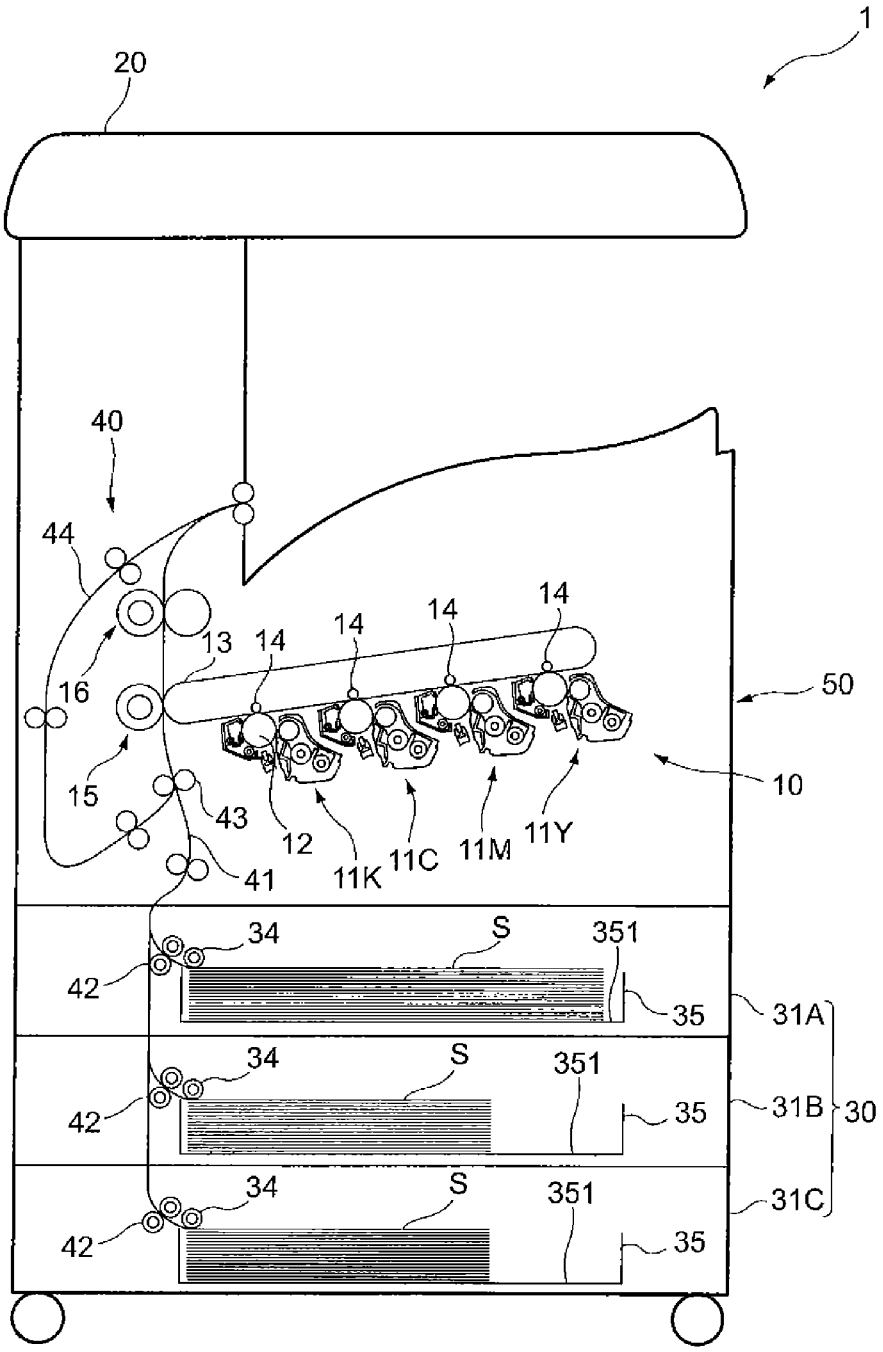
FIG. 1 is a view illustrating an entire configuration of an image forming apparatus of an embodiment.

FIG. 1 is a view illustrating an entire configuration of an image forming apparatus 1 of the embodiment.

As illustrated in FIG. 1, the image forming apparatus 1 includes an image forming section 10 that forms an image corresponding to image data of each color, an image reading device 20 that reads the image of a document, a sheet supply section 30 that supplies a sheet to the image forming section 10, and a sheet transportation system 40 that transports the sheet supplied from the sheet supply section. Furthermore, the image forming apparatus 1 has a body housing 50 that stores each configuration section such as the image forming section 10.

The image forming section 10 is provided with four image forming units 11Y, 11M, 11C, and 11K arranged in parallel at regular intervals. Each of the image forming units 11Y, 11M, 11C, and 11K includes a photosensitive drum 12 that holds a toner image by forming an electrostatic latent image and forms the toner image by a so-called electrophotographic system. Each of the image forming units 11Y, 11M, 11C, and 11K forms respectively the toner images of yellow (Y), magenta (M), cyan (C), and black (K).

Furthermore, the image forming section 10 includes a middle transfer belt 13 that transfers each color toner image formed on the photosensitive drum 12 of each image forming unit 11. Furthermore, the image forming section 10 includes a primary transfer roll 14 that sequentially transfers (primarily transfers) each color toner image formed in each image forming unit 11 onto the middle transfer belt 13. Furthermore, the image forming section 10 includes a secondary transfer section 15 that collectively transfers (secondarily transfers) each color toner image formed by being laminated on the middle transfer belt 13 onto a sheet S that is a recording material (recording sheet) and a fixing section 16 in which each color toner image that is secondarily transferred is fixed on the sheet S.

In the embodiment, the sheet supply section 30 is configured to include a first sheet storage section 31A, a second sheet storage section 31B, and a third sheet storage section 31C that supply the sheet S from a sheet bundle stored in a stacking member 351 (described later). Furthermore, each sheet storage section is provided with a drawing section 35 that stores respective bundles of the sheets S and is capable of being drawn out with respect to the body housing 50, and a feeding roll 34 that feeds the uppermost sheet S from the bundle of the sheets S stored in the drawing section 35. Then, the sheet supply section 30 supplies the sheet S fed from each sheet storage section to the sheet transportation system 40.

Moreover, in the following description, if the first sheet storage section 31A, the second sheet storage section 31B, and the third sheet storage section 31C are not particularly distinguished, the sections are collectively referred to as the sheet storage section 31.

The sheet transportation system 40 has a transport path 41, a handling roll 42, a registration roll 43, and a reverse transport path 44.

The transport path 41 forms a path from the sheet supply section 30 to the outside of the body housing 50 in which the sheet S is discharged through the secondary transfer section 15 and the fixing section 16.

The handling roll 42 transports the sheets S by handling the sheets S one by one that is fed from the feeding roll 34.

The registration roll 43 temporarily stops the transportation of the sheet S in a state where rotation is stopped and performs the rotation at a predetermined timing, and thereby supplying the sheet S while performing registration adjustment to the secondary transfer section 15.

The reverse transport path 44 forms a path for supplying again the sheet S to the secondary transfer section 15 by reversing the surface and back of the sheet S passed through the fixing section 16.

Figure 2:
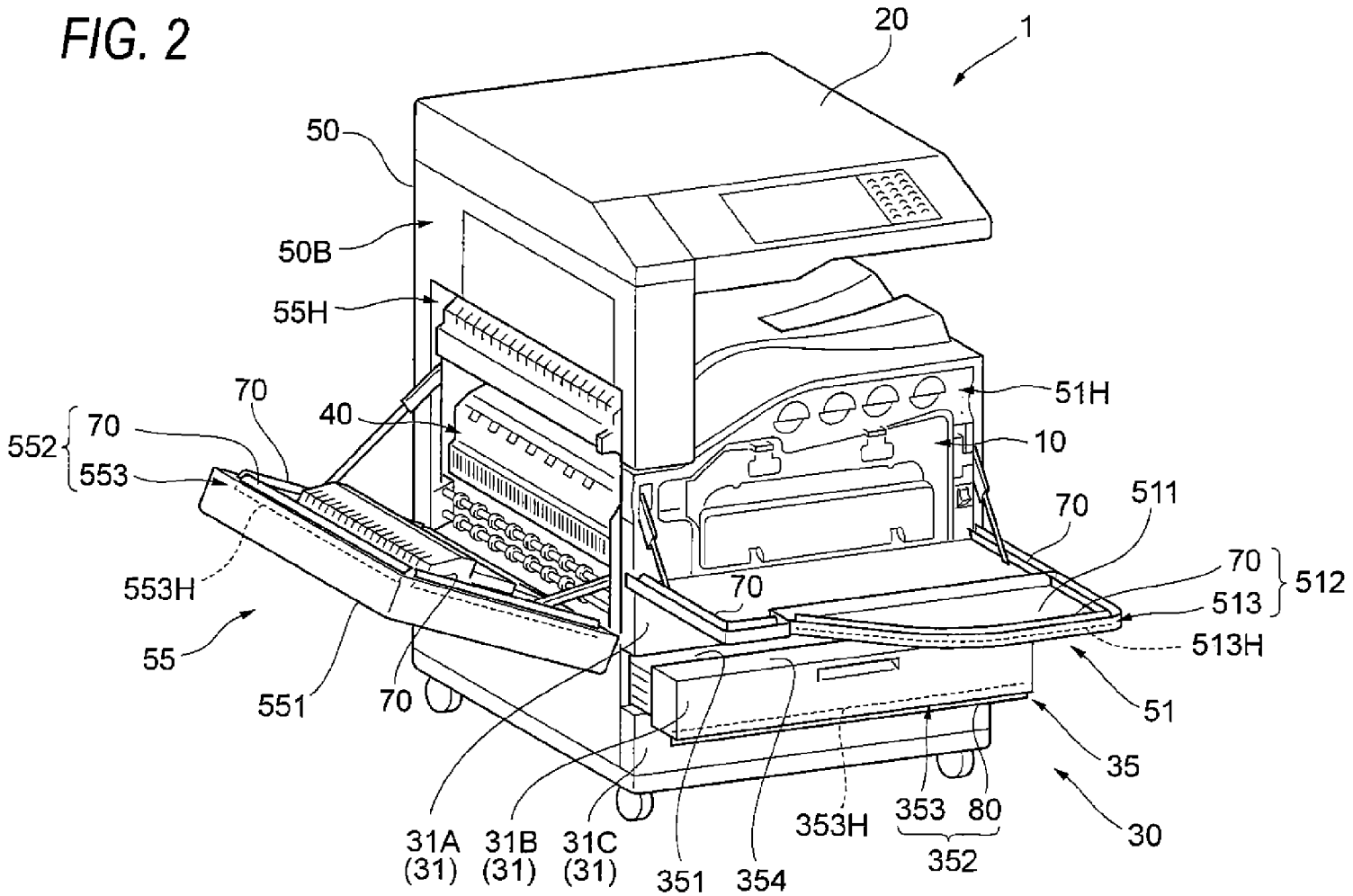
FIG. 2 is a view illustrating a body housing and a sheet supply section in detail.

FIG. 2 is a view illustrating the body housing 50 and the sheet supply section 30 in detail.

As illustrated in FIG. 2, the body housing 50 has a housing member 50B that covers each configuration section, a front opening section 51H that is an opening formed in the housing member 50B, and a side opening section 55H that is an opening formed in the housing member 50B. Furthermore, the body housing 50 has a front door section 51 that is provided to face the front opening section 51H and a side door section 55 that is provided to face the side opening section 55H.

The front opening section 51H is positioned on the front side that is a side facing a user utilizing the image forming apparatus 1. Furthermore, the front opening section 51H is provided to correspond to a position in which the image forming section 10 is disposed.

The side opening section 55H is positioned on a side of the image forming apparatus 1. Furthermore, the side opening section 55H is provided to correspond to a position in which the sheet transportation system 40 is disposed.

As illustrated in FIG. 2, the front door section 51 has a door plate 511 and a front sealing section 512.

The door plate 511 has a shape that conforms to an outer shape of the front opening section 51H. Furthermore, the door plate 511 swings in an up and down direction of the image forming apparatus 1 through a hinge (not illustrated). Then, the door plate 511 is openably mounted on the front opening section 51H. The door plate 511 is molded in a plate shape with a resin material and does not include functional parts necessary for the image formation.

Moreover, in a state where the door plate 511 is opened, it is possible for the user and the like to operate various members configuring each image forming unit 11. For example, in a state where the door plate 511 of the front door section 51 is opened, it is possible to perform replacement of the photosensitive drum 12 or replacement of a toner bottle storing each color toner in the image forming unit 11.

The front sealing section 512 is configured to include a gasket 70 as an example of a sealing member and a gasket holding section 513 that holds the gasket 70.

The gasket 70 is mounted on the inside of an edge of the door plate 511 so as to conform to the outer shape of the door plate 511. Then, the gasket 70 seals a gap between the front opening section 51H and the door plate 511 in a state where the door plate 511 is closed. In the embodiment, the gasket 70 reduces leakage of operation noise and the like of, for example, the image forming section 10 and the like positioned inside the body housing 50 to the outside. Moreover, the gasket 70 will be described below in detail.

The gasket holding section 513 is formed corresponding to a portion in which the gasket 70 is provided in the door plate 511. In the embodiment, the gasket holding section 513 is configured of a holding groove 513H of which a cross section has a recessed shape. Then, the gasket holding section 513 holds the gasket 70 by inserting a part of the gasket 70 into the holding groove 513H.

As illustrated in FIG. 2, the side door section 55 is configured to include a cover member 551 and a side sealing section 552.

The cover member 551 has a shape that conforms to the outer shape of the side opening section 55H. Furthermore, the cover member 551 is openably mounted on the housing member 50B through a hinge (not illustrated).

The side sealing section 552 is configured to include the gasket 70 and a gasket holding section 553 that holds the gasket 70. Moreover, the gasket 70 that is provided in the side door section 55 and the gasket 70 that is provided in the front door section 51 described above have the same basic configuration in which only portions where the gaskets are provided are different from each other.

In the embodiment, the gasket holding section 553 is configured of a holding groove 553H of which a cross section has a recessed shape. Then, the gasket holding section 553 holds the gasket 70 by inserting a part of the gasket 70 into the holding groove 553H.

Moreover, in a state where the cover member 551 is opened, a part of the sheet transportation system 40 is in an exposed state. For example, if the sheet S is jammed in the transport path 41, the transport path 41 is exposed by opening the cover member 551 and it is possible to directly remove the jammed sheet S.

The gasket 70 in the side door section 55 is mounted on the inside of an edge of the cover member 551 so as to conform to the outer shape of the cover member 551. Then, the gasket 70 seals a gap between the side opening section 55H and the cover member 551 in a state where the cover member 551 is closed. In the embodiment, in the side door section 55, the gasket 70 reduces leakage of operation noise and the like of, for example, the sheet transportation system 40 or the image forming section 10 and the like positioned inside the body housing 50 to the outside.

Sequentially, the drawing section 35 of the sheet storage section 31 will be described in detail.

The drawing section 35 has the stacking member 351, a drawing sealing section 352, and a contacted section 354.

The stacking member 351 has a recessed shape and stacks a bundle of the sheets S (see FIG. 1).

The drawing sealing section 352 is configured to include a second gasket 80 as an example of a sealing member and a gasket holding section 353 that holds the second gasket 80.

As illustrated in FIG. 2, the second gasket 80 is provided on a rear side opposite to the stacking member 351 in the drawing section 35. Then, the second gasket 80 is an end portion of the drawing section 35 on the front side and is provided to extend along a direction intersecting the drawing direction. In the embodiment, the second gasket 80 is provided respectively in each drawing section 35 of the first sheet storage section 31A, the second sheet storage section 31B, and the third sheet storage section 31C. Furthermore, in the embodiment, the second gasket 80 is also provided in a portion of the housing member 50B facing the first sheet storage section 31A to seal between the housing member 50B and an upper side of the first sheet storage section 31A.

Then, in the embodiment, the second gasket 80 reduces leakage of operation noise and the like of, for example, the image forming section 10 and the like positioned inside the body housing 50 to the outside. Moreover, the second gasket 80 will be described below in detail.

The gasket holding section 353 is formed on the drawing section 35 to correspond to a portion in which the second gasket 80 is provided. In the embodiment, the gasket holding section 353 is configured of a holding groove 353H of which a cross section has a recessed shape. Then, the gasket holding section 353 holds the second gasket 80 by inserting a part of the second gasket 80 into the holding groove 353H.

The contacted section 354 comes into contact with the second gasket 80 and forms a portion in which a gap is closed together with the second gasket 80. In the embodiment, each contacted section 354 is provided in a portion facing each second gasket 80 in the first sheet storage section 31A, the second sheet storage section 31B, and the third sheet storage section 31C. In the embodiment, each second gasket 80 is provided on a lower side of each drawing section 35 of each of the first sheet storage section 31A, the second sheet storage section 31B, and the third sheet storage section 31C. Thus, the contacted section 354 is disposed on an upper side of each drawing section 35 of the first sheet storage section 31A, the second sheet storage section 31B, and the third sheet storage section 31C.

Figure 3:
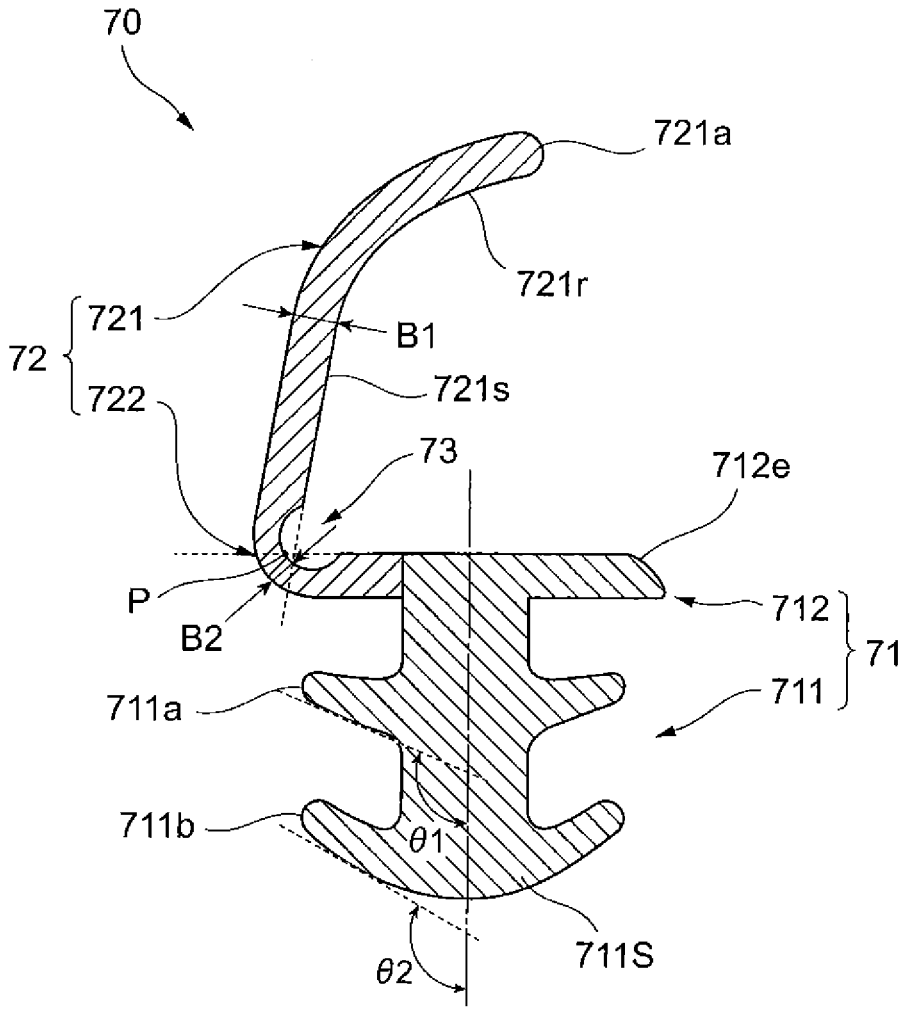
FIG. 3 is a cross-sectional view of a gasket of the embodiment.

FIG. 3 is a cross-sectional view of the gasket 70 of the embodiment.

Moreover, FIG. 3 illustrates a cross section that is taken in a direction intersecting the longitudinal direction of the gasket 70. Furthermore, the gasket 70 has the same cross section shape in any arbitrary positions in the longitudinal direction thereof. Furthermore, in the following description, the gasket 70 provided in the gasket holding section 513 is described as an example.

As illustrated in FIG. 3, the gasket 70 is configured to include a connection section 71 as an example of a mounting section that is connected to the holding groove 513H (see FIG. 2) of the gasket holding section 513, and a sealing section 72 as an example of an extension section that closes a gap by coming into contact with the housing member 50B (see FIG. 2) as a target to be sealed. Moreover, in the embodiment, the connection section 71 and the sealing section 72 are integrally configured. Moreover, as a material of the gasket 70 of the embodiment, rubber material may be used.

The connection section 71 is configured to have an inserting section 711 and a base section 712.

The inserting section 711 includes a shaft section 711S, a first protrusion section 711*a* that is provided in the shaft section 711S, a second protrusion section 711*b* that is provided in the shaft section 711S.

The first protrusion section 711*a* is on the inside more than the second protrusion section 711*b* in an axial direction and is disposed closer to the sealing section 72. The first protrusion section 711*a* is configured of a pair of convex sections protruding from the shaft section 711S. Then, a width between lead edge sections of the first protrusion section 711*a* is wider than that of the holding groove 513H of the gasket holding section 513. Therefore, when inserting the inserting section 711 into the holding groove 513H, a degree of a friction force under which the first protrusion section 711*a* is unlikely to be loose is generated by compressing and deforming the first protrusion section 711*a*.

Furthermore, as illustrated in FIG. 3, the first protrusion section 711*a* has a predetermined angle {th} 1 with respect to the shaft section 711S.

The second protrusion section 711*b* is positioned in an end portion opposite to the sealing section 72 in the gasket 70. Similar to the first protrusion section 711*a*, the second protrusion section 711*b* is configured of a pair of convex sections protruding from the shaft section 711S. A width between lead edge sections of the second protrusion section 711*b* is wider than that of the holding groove 513H. Similar to the first protrusion section 711*a*, when inserting the inserting section 711 into the holding groove 513H, a degree of a friction force under which the first protrusion section 711*a* is unlikely to be loose is generated by compressing and deforming the second protrusion section 711*b*.

Furthermore, as illustrated in FIG. 3, the second protrusion section 711*b* has a predetermined angle {th} 2 with respect to the shaft section 711S and the angle {th} 2 is greater than the angle {th} 1 with respect to the shaft section 711S of the first protrusion section 711*a*, in the embodiment.

In the embodiment, the inserting section 711 is easily inserted into the holding groove 513H by increasing the angle {th}2 of the second protrusion section 711*b* that is positioned in the end portion in an insertion direction when mounting the gasket 70 on the gasket holding section 513. On the other hand, for the first protrusion section 711*a* that is not positioned in the end portion, priority is given to a function with which the first protrusion section 711*a* is unlikely to be loose from the holding groove 513H by decreasing the angle {th} 1.

As described above, in the embodiment, the insertion is easily performed when mounting the gasket 70 on the gasket holding section 513 and it becomes hard to be loose after the mounting by providing the angles of the first protrusion section 711*a* and the second protrusion section 711*b* to be different from each other.

The base section 712 is formed such that a width thereof is greater than that of the holding groove 513H (see FIG. 2) of the gasket holding section 513. The base section 712 is formed to extend in a direction intersecting the shaft section 711S. Then, the base section 712 is caught in an edge of the holding groove 513H so that the base section 712 is remained in a state where the inserting section 711 is inserted into a predetermined depth with respect to the holding groove 513H (see FIG. 5 described below). Furthermore, the base section 712 supports the sealing section 72 so that the sealing section 72 is erected in a predetermined shape in a state where the gasket 70 is mounted on the gasket holding section 513.

Furthermore, a cross section of an end portion 712*e* of the base section 712 is formed in a tapered shape. Specifically, the end portion 712*e* is configured such that a thickness thereof becomes gradually thin toward the outside. Therefore, in the embodiment, for example, if the base section 712 comes into contact with other members and the like, the gasket 70 is prevented from being disengaged due to catching of the other members into the base section 712.

As illustrated in FIG. 3, the cross section of the sealing section 72 has a substantially L-shape. Then, the sealing section 72 is configured to have a rising section 721 and a bending section 722 as an example of a deformation section.

The rising section 721 is a portion that extends and is erected away from the base section 712. The rising section 721 has a linear section 721*s* extending along the axial direction of the shaft section 711S in the connection section 71 and an arc section 721*r* that is continuous to the linear section 721*s* and draws an arc toward an end portion 721*a*.

Then, in the sealing section 72 of the embodiment, one end side of the rising section 721 is connected to the connection section 71 through the bending section 722 and the arc section 721*r* that is positioned on the other end side of the rising section 721 is not connected to the connection section 71. As described above, the gasket 70 of the embodiment is supported by the connection section 71 in a state where the sealing section 72 is supported in a so-called cantilevered type.

When the sealing section 72 comes into contact with the housing member 50B that is a target member, the bending section 722 facilitates the deformation of the rising section 721 that is collapsed. In the embodiment, a recess section 73 that is recessed inwardly from the surface is provided on one end side (a left end portion in FIG. 3) of the base section 712. The recess section 73 is also continuous to one end side of the rising section 721. The bending section 722 is formed by the recess section 73 and the bending section 722 has a portion of which a thickness B2 is thinner than a thickness B1 of the rising section 721. As illustrated in FIG. 3, the recess section 73 is formed such that a cross section shape thereof is an arc shape. Therefore, for example, a rigidity of the bending section 722 is less than that of the rising section 721. Then, as described below, when the sealing section 72 comes into contact with the target member (the housing member 50B), the rising section 721 is deformed so as to be collapsed about the bending section 722 as a fulcrum of the deformation.

The recess section 73 is configured such that a surface of the base section 712 on the side of the rising section 721 is recessed. The rising section 721 extends from the recess section 73 so that projection of the rising section 721 covers the recess section 73 in the axial direction of a central axis of the shaft section 711S.

Furthermore, in the cross section illustrated in FIG. 3, the recess section 73 is recessed on the side of the base section 712 more than an imaginary extension line that is extended from the upper surface of the base section 712. Furthermore, the recess section 73 is recessed more than an imaginary extension line that is extended from a surface of the linear section 721*s* on the side of the base section 712.

Furthermore, an intersecting point P between the imaginary extension line that is extended from the upper surface of the base section 712 and the bending section 722 is substantially a center of circumferential length of the arc shape of the bending section 722. Then, when performing the opening and closing operation, the rising section 721 is collapsed about the intersecting point P as the fulcrum. Since the bending section 722 is recessed on the side of the base section 712 more than the imaginary extension line that is extended from the upper surface of the base section 712, the intersecting point P is the side closer to the base section 712.

Furthermore, the bending section 722 is not positioned along the central axis of the shaft section 711S but is provided in a position deviated from the central axis of the shaft section 711S. Therefore, in the embodiment, when mounting the gasket 70 on the gasket holding section 513, the connection section 71 is not excessively pushed into the holding groove 513H of the gasket holding section 513.

When mounting the gasket 70, for example, the gasket 70 is pushed into the holding groove 513H using a mounting jig such as a roller. At this time, in the gasket 70, the sealing section 72 is pushed by the mounting jig. Then, in the embodiment, the bending section 722 configuring a connection portion to the connection section 71 is deviated with respect to the central axis of the shaft section 711S of the connection section 71. Thus, it is possible to prevent for the inserting section 711 from being excessively pushed into the holding groove 513H by positioning the bending section 722 of the sealing section 72, in which the strongest force is applied, in a position deviated from the shaft section 711S.

The gasket 70 to which the embodiment is applied is configured such that a hardness of the sealing section 72 is smaller than that of the connection section 71. For example, a rubber hardness (JTS-A) of the connection section 71 is set to be approximately 80° and a harness of the scaling section 72 is, for example, set to be 40°. Then, in the embodiment, the rigidity of the sealing section 72 is smaller than that of the connection section 71 by providing different hardness in the connection section 71 and the sealing section 72.

Moreover, for manufacturing the gasket 70 of the embodiment, a mold molding the connection section 71 and the sealing section 72 is used. Then, a first material that is blended to obtain the hardness of the connection section 71 and a second material that is blended to obtain the hardness of the sealing section 72 are filled respectively in corresponding portions of the mold. Then, the gasket 70 in which the connection section 71 having a predetermined hardness and the sealing section 72 having the hardness lower than that of the connection section 71 are formed is obtained.

Figure 4:
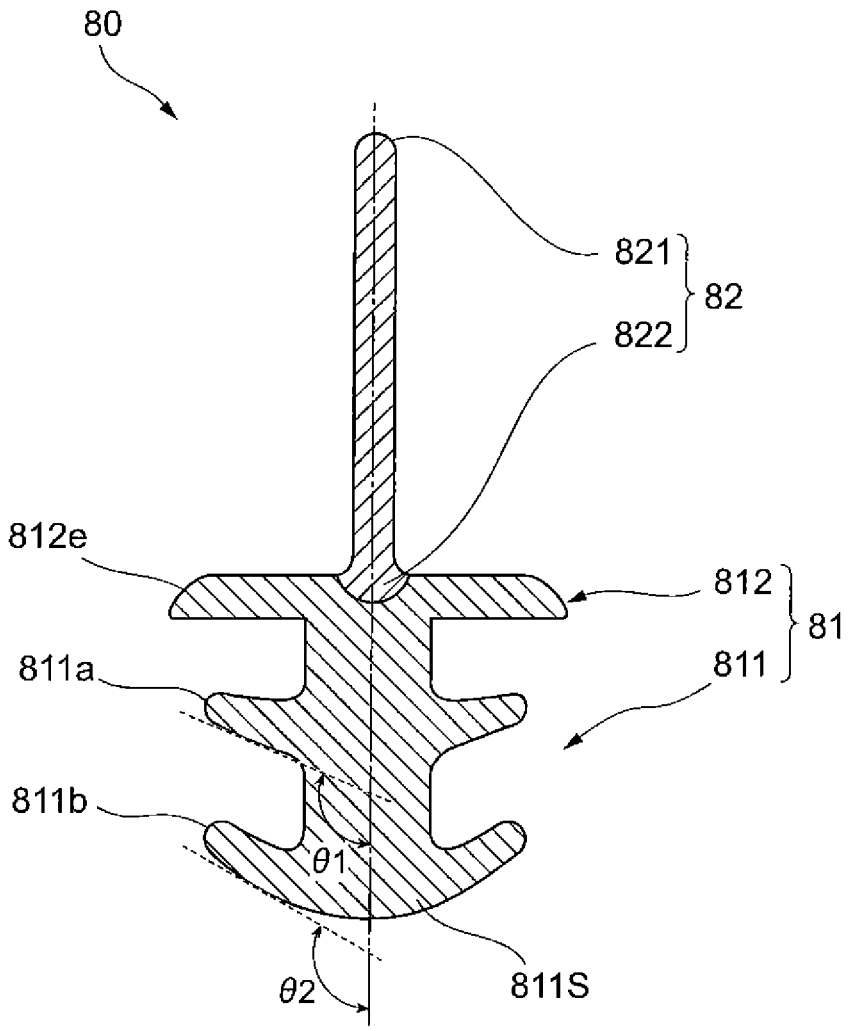
FIG. 4 is a cross-sectional view of a second gasket of the embodiment.

FIG. 4 is a cross-sectional view of a second gasket 80 of the embodiment.

Moreover, FIG. 4 illustrates a cross section that is taken in a direction intersecting the longitudinal direction of the second gasket 80. Furthermore, the second gasket 80 has the same cross section shape in any arbitrary positions in the longitudinal direction thereof.

As illustrated in FIG. 4, the second gasket 80 is configured to include a connection section 81 as an example of a mounting section that is connected to the holding groove 353H (see FIG. 2) of the gasket holding section 353, and a sealing section 82 as an example of an extension section that closes a gap by coming into contact with the housing member 50B (see FIG. 2) as a target to be sealed. Moreover, in the embodiment, the connection section 81 and the sealing section 82 are integrally configured. Moreover, as a material of the second gasket 80 of the embodiment, rubber material may be used.

The connection section 81 is configured to have an inserting section 811 and a base section 812.

The inserting section 811 includes a shaft section 811S, a first protrusion section 811*a* that is provided in the shaft section 811S, a second protrusion section 811*b* that is provided in the shaft section 811S.

The first protrusion section 811*a* is on the inside more than the second protrusion section 811*b* in an axial direction and is disposed closer to the sealing section 82. The first protrusion section 811*a* is configured of a pair of convex sections protruding from the shaft section 811S. Then, a width between lead edge sections of the first protrusion section 811*a* is wider than that of the holding groove 353H of the gasket holding section 353.

Furthermore, as illustrated in FIG. 4, the first protrusion section 811*a* has a predetermined angle {th} 1 with respect to the shaft section 811S.

The second protrusion section 811*b* is positioned in an end portion opposite to the sealing section 82 in the second gasket 80. Similar to the first protrusion section 811*a*, the second protrusion section 811*b* is configured of a pair of convex sections protruding from the shaft section 811S. A width between lead edge sections of the second protrusion section 811*b* is wider than that of the holding groove 353H.

Furthermore, as illustrated in FIG. 4, the second protrusion section 811*b* has a predetermined angle {th} 2 with respect to the shaft section 811S and the angle {th} 2 is greater than the angle {th} 1 with respect to the shaft section 811S of the first protrusion section 811*a*, in the embodiment.

The base section 812 is formed such that a width thereof is greater than that of the holding groove 353H (see FIG. 2) of the gasket holding section 353. The base section 812 is formed to extend in a direction intersecting the shaft section 811S. Then, the base section 812 is caught in an edge of the holding groove 353H so that the base section 812 is remained in a state where the inserting section 811 is inserted into a predetermined depth with respect to the holding groove 353H (see FIG. 6 described below). Furthermore, the base section 812 supports the sealing section 82 so that the sealing section 82 is erected in a predetermined shape in a state where the second gasket 80 is mounted on the holding groove 353H.

Furthermore, a cross section of an end portion 812*e* of the base section 812 is formed in a tapered shape. Specifically, the end portion 812*e* is configured such that a thickness thereof becomes gradually thin toward the outside. Therefore, for example, if the base section 812 comes into contact with other drawing sections 35, the second gasket 80 is prevented from being disengaged due to catching of the other drawing section 35 into the base section 812.

As illustrated in FIG. 4, the cross section of the sealing section 82 has a substantially I-shape. Then, the sealing section 82 has a rising section 821 and a base section 822 as an example of a deformation section.

The rising section 821 is a portion that extends and is erected away from the base section 812. In the embodiment, the rising section 821 is deformed so as to be collapsed in an approaching direction to the connection section 81 so that a gap between the other drawing sections 35 is sealed.

The base section 822 is provided in the end portion of the rising section 821 and a width thereof is formed wider than that of the rising section 821. Furthermore, the base section 822 is a connection portion between the sealing section 82 and the connection section 81. Thus, the base section 822 is connected to the connection section 81 so as to be embedded in the axial direction of the shaft section 811S of the connection section 81.

In the embodiment, the base section 822 is connected to the connection section 81 so as to be embedded in the axial direction of the base section 812 of the connection section 81 and the width of the rising section 821 is thicker than that of the other portions. Therefore, when mounting the second gasket 80 on the gasket holding section 353, the connection section 81 is not excessively pushed into the holding groove 353H.

That is, when mounting the second gasket 80, in the second gasket 80, a mounting jig presses the sealing section 82 side when pressing the second gasket 80 using the mounting jig. Then, in the embodiment, a force applied to the sealing section 82 is dispersed in the base section 822 and then is applied to the base section 812 and the shaft section 811S by connecting through the base section 822 having a wide width in the axial direction of the shaft section 811S of the connection section 81. Thus, it is possible to prevent for the inserting section 811 of the second gasket 80 from being excessively pushed into the holding groove 353H.

Moreover, in the second gasket 80, excessive pushing of the inserting section 811 into the holding groove 353H may be prevented by disposing the center axis of the sealing section 82 to be deviated from the center axis of the shaft section 811S of the connection section 81 and by deviating the force received from the mounting jig through the sealing section 82 from the shaft section 811S.

Moreover, the second gasket 80 to which the embodiment is applied is configured such that a hardness of the sealing section 82 is smaller than that of the connection section 81. For example, a rubber hardness of the connection section 81 is set to be approximately 80° and a harness of the sealing section 82 is, for example, set to be 40°. Then, in the embodiment, the rigidity of the sealing section 82 is smaller than that of the connection section 81 by providing different hardness in the connection section 81 and the sealing section 82.

Moreover, a manufacturing method of the second gasket 80 is the same as that of the gasket 70 described above.

Sequentially, the sealing operation the gasket 70 and the second gasket 80 will be described.

Figure 5:
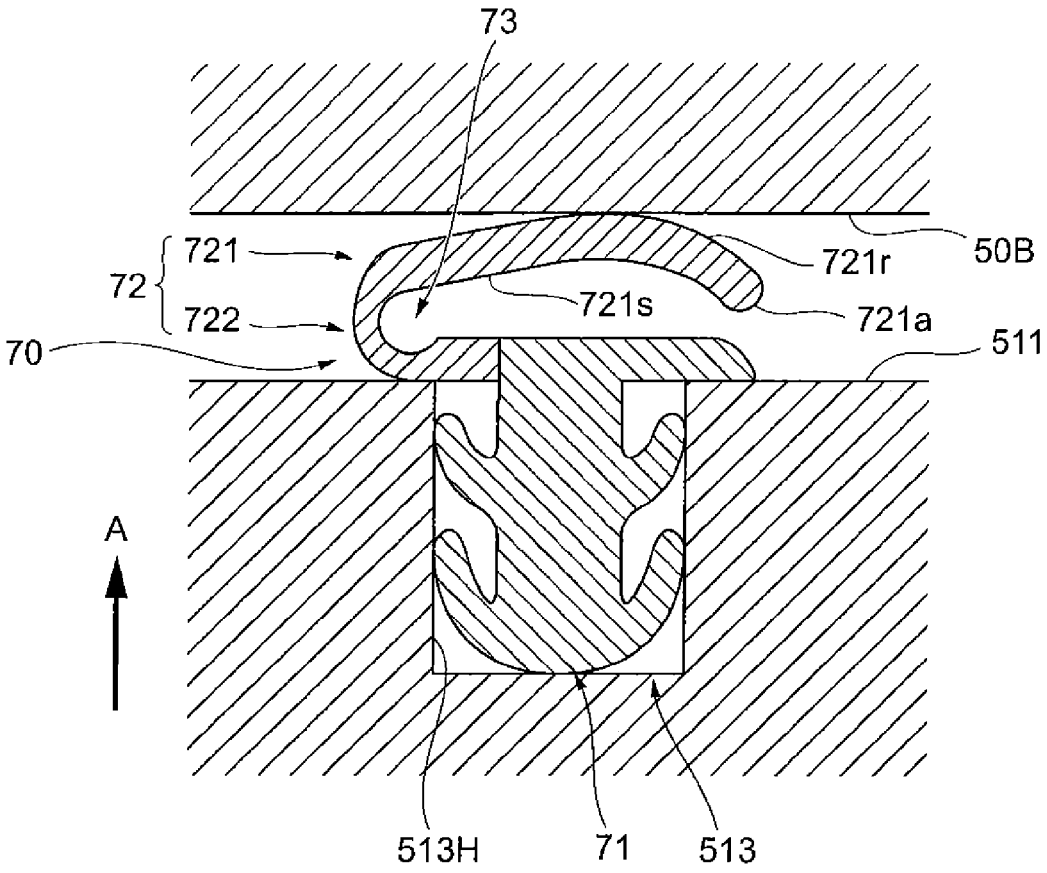
FIG. 5 is a view illustrating a sealing operation of the gasket.

FIG. 5 is a view illustrating the sealing operation of the gasket 70.

When the door plate 511 of the front door section 51 changes from the open state (see FIG. 2) to the closed state, as illustrated in FIG. 5, the gap is closed by the rising section 721 of the sealing section 72. At this time, in the gasket 70, the sealing section 72 is displaced in an approaching direction to the connection section 71 by coming into contact with the housing member 50B. At this time, in the sealing section 72, the bending section 722 that is formed thinner than other portions and is configured to be likely to bend is deformed. Then, the rising section 721 continuous to the bending section 722 is deformed in an approaching direction to the connection section 71. Furthermore, when the rising section 721 is deformed in the approaching direction to the connection section 71, since the recess section 73 is formed, the rising section 721 does not come into contact with the connection section 71. Moreover, the door plate 511 approaches the housing member 50B from direction A of FIG. 5.

Then, the gasket 70 operates such that operation noise of the image forming section 10 (see FIG. 1) and the like that are provided inside the housing member 50B of the image forming section 10 and the like is not leaked to the outside by sealing the gap so as to close the gap between the housing member 50B and the door plate 511.

Furthermore, as described above, the gasket 70 has the bending section 722 that operates so as for the sealing section 72 to be easily deformed and the rising section 721 does not come into contact with the connection section 71 when being deformed. Therefore, when coming into contact with the housing member 50B, the operational force of the opening and closing operation of the door plate 511 is reduced.

Furthermore, as illustrated in FIG. 5, in the gasket 70 of the embodiment, the rising section 721 is supported in a state of being supported in a so-called cantilevered type. Then, even in a state where the door plate 511 is closed best with respect to the housing member 50B, the end portion 721*a* of the rising section 721 does not come into contact with other portions such as the base section 712 or the door plate 511. Furthermore, the entirety of the sealing section 72 in addition to the end portion 721*a* does not come into contact with the other portions such as the base section 712 or the door plate 511. As described above, as the material of the gasket 70, rubber materials are used and if the rubber materials come into contact with each other over a long period of time, there is a concern that the rubber materials are adhered to each other.

Furthermore, the recess section 73 is formed such that the surface of the base section 712 on the side of the rising section 721 is recessed toward the inside thereof and the rising section 721 extends from the recess section 73. Therefore, for example, the gap between the housing member 50B and the door plate 511 which the gasket 70 seals is narrower than that of a case where, for example, the recess section 73 is only provided in the rising section 721.

Furthermore, in the embodiment, the rigidity of the sealing section 72 is reduced by relatively reducing the hardness of the sealing section 72 that is a portion to be displaced or deformed along with opening and closing of the door plate 511. Thus, an operational force that is necessary to deform the gasket 70 when opening and closing of the door plate 511 is reduced. On the other hand, the rigidity is increased by relatively increasing the hardness of the connection section 71 that maintains the connection to the gasket holding section 513. Therefore, the gasket 70 is unlikely to disengage from the gasket holding section 513.

Moreover, in the embodiment, the rigidity of the bending section 722 is reduced and deformation is easily performed by reducing the thickness thereof compared to that of the other portions, but the invention is not limited to the configuration. For example, even if the thickness of the portion corresponding to the bending section 722 is the same as that of the other portions, the rigidity may be reduced by further reducing the hardness of the rubber of the portion corresponding to the bending section 722 compared to that of, for example, the rising section 721. Also, in this case, when the sealing section 72 comes into contact with the housing member 50B, the sealing section 72 is likely to be deformed and the operational force of the opening and closing operation of the door plate 511 is reduced.

Figure 6:
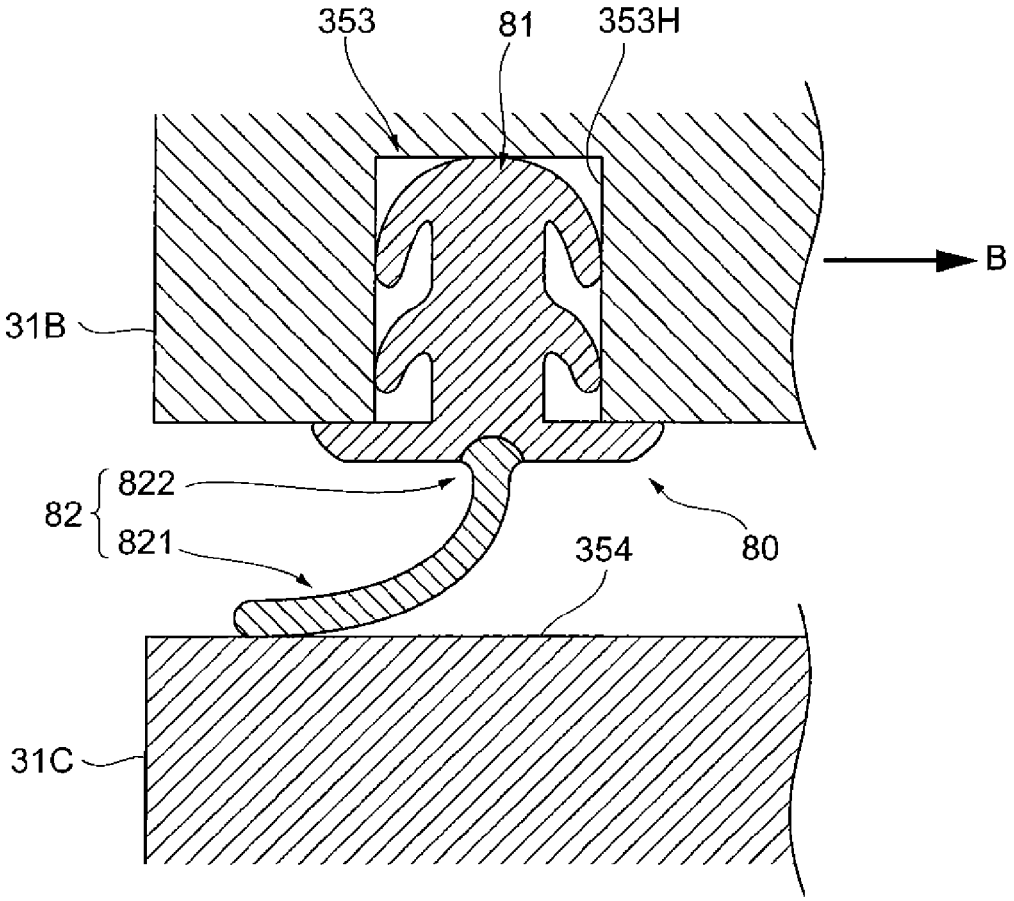
FIG. 6 is a view illustrating a sealing operation of the second gasket.

FIG. 6 is a view illustrating the sealing operation of the second gasket 80.

Moreover, hereinafter, the second sheet storage section 31B (see FIG. 2) is described as an example.

The drawing section 35 is in a state of being stored from a state where the drawing section 35 of the second sheet storage section 31B is drawn out (see FIG. 2). Then, as illustrated in FIG. 6, a gap between the second sheet storage section 31B and the contacted section 354 of the third sheet storage section 31C is closed by the rising section 821 of the sealing section 82 in the second gasket 80. Furthermore, at this time, the second gasket 80 comes into contact with the contacted section 354 and the sealing section 82 is displaced so as to collapse in an approaching direction to the connection section 81.

Then, the second gasket 80 seals so as to close the gap between the second sheet storage section 31B and the third sheet storage section 31C. Therefore, the second gasket 80 is operated such that the operation noise of the operation section such as the image forming section 10 and the like that are provided inside the housing member 50B is not leaked to the outside.

Moreover, the second sheet storage section 31B is in a state of being stored in the drawing section 35 by moving in direction B of FIG. 6.

As described above, the rigidity of the sealing section 82 is reduced by setting the hardness to be lowered compared to that of the connection section 81. Thus, when performing the opening and closing operation of the drawing section 35, the second gasket 80 allows the operational force to be reduced when the operation of pushing or drawing of the drawing section 35 is performed.

Specifically, in the embodiment, the hardness of the base section 822 that is the connection portion with the connection section 81 is also reduced compared to that of the connection section 81. Thus, the second gasket 80 is configured such that the base section 822 that is the fulcrum of bending deformation of the sealing section 82 is likely to be deformed. Thus, in the second gasket 80 of the embodiment, the operational force is further reduced when the opening and closing operation of the drawing section 35 is performed.

On the other hand, the second gasket 80 is configured such that the hardness of the connection section 81 that maintains the connection with the gasket holding section 353 is increased compared to that of the sealing section 82. Therefore, the second gasket 80 is unlikely to disengage from the gasket holding section 353.

Moreover, in the embodiment, the second gasket 80 is configured such that the entirety of the sealing section 82 has a low hardness thereby being likely to be deformed, but the invention is not limited to the configuration. For example, in terms of facilitating the collapse of the rising section 821, the rigidity is reduced and deformation is easily performed by reducing the thickness of the portion corresponding to the base section 822 compared to that of the other portions.

Furthermore, in the embodiment, the configuration is employed such that the gaskets 70 is mounted on the door plate 511 and the cover member 551, respectively, but the invention is not limited to the configuration. For example, a configuration may be employed such that the gasket 70 is held by the housing member 50B.

Furthermore, in the embodiment, the second gasket 80 is provided on the lower side opposite to the stacking member 351 in each sheet storage section 31, but the second gasket 80 may be mounted on the side in which the stacking member 351 is provided. However, in the embodiment, operability is prevented from being lowered by disposing the second gasket 80 on the lower side of each drawing section 35 when stacking the sheets in the stacking member 351.

Figure 7:
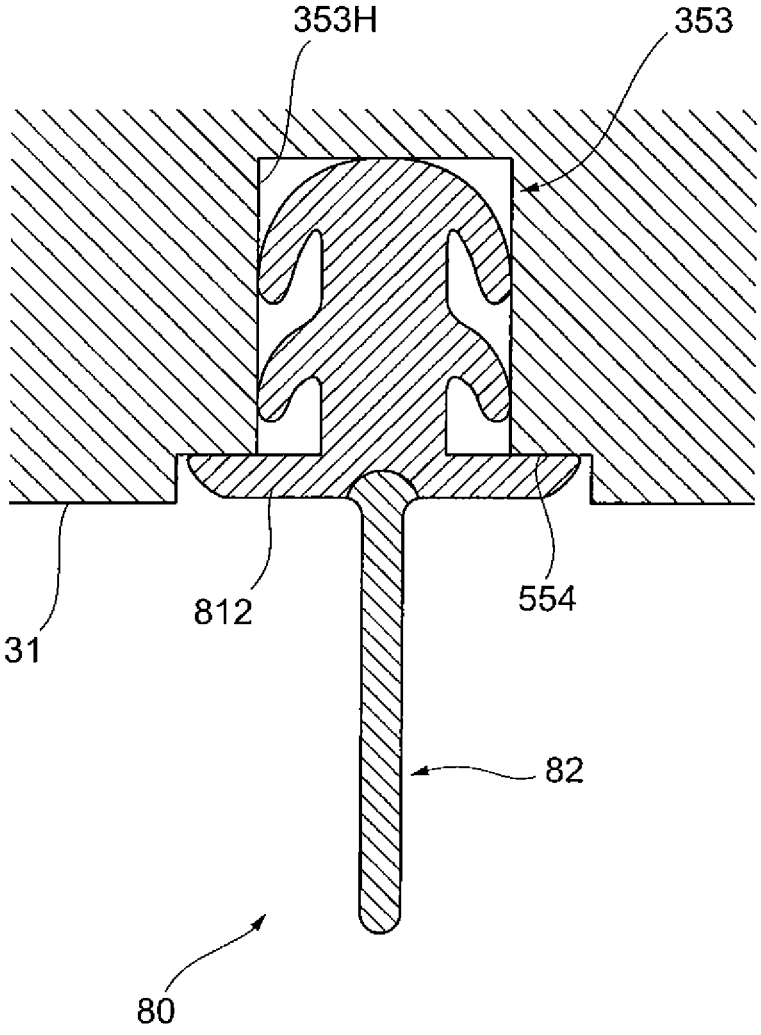
FIG. 7 is a view illustrating a gasket holding section of a modification example.

FIG. 7 is a view illustrating a gasket holding section 353 of a modification example.

As illustrated in FIG. 7, the gasket holding section 353 of the modification example has a concave portion 554 around a groove for holding the second gasket 80. The concave portion 554 is formed corresponding to an outer shape of the base section 812 of the connection section 81 in the second gasket 80. That is, the concave portion 554 has a width greater than that of the base section 812 and is configured to have a depth that is equal to or more than the thickness of the base section 812 in the thickness direction.

When holding the second gasket 80 in the gasket holding section 353 of the modification example having such a configuration, the base section 812 is in a state of being fitted into the concave portion 554. Thus, the base section 812 is held in a state of being retracted without protruding from a mounting surface of the drawing section 35.

Therefore, for example, in the gasket holding section 353 of the modification example, the drawing section 35 is caught into the base section 812 of the second gasket 80 in the opening and closing operation of the drawing section 35 and thereby the second gasket 80 is prevented from disengaging from the gasket holding section 353.

Sequentially, the drawing section 35 of the embodiment will be described in detail.

Figure 8A:
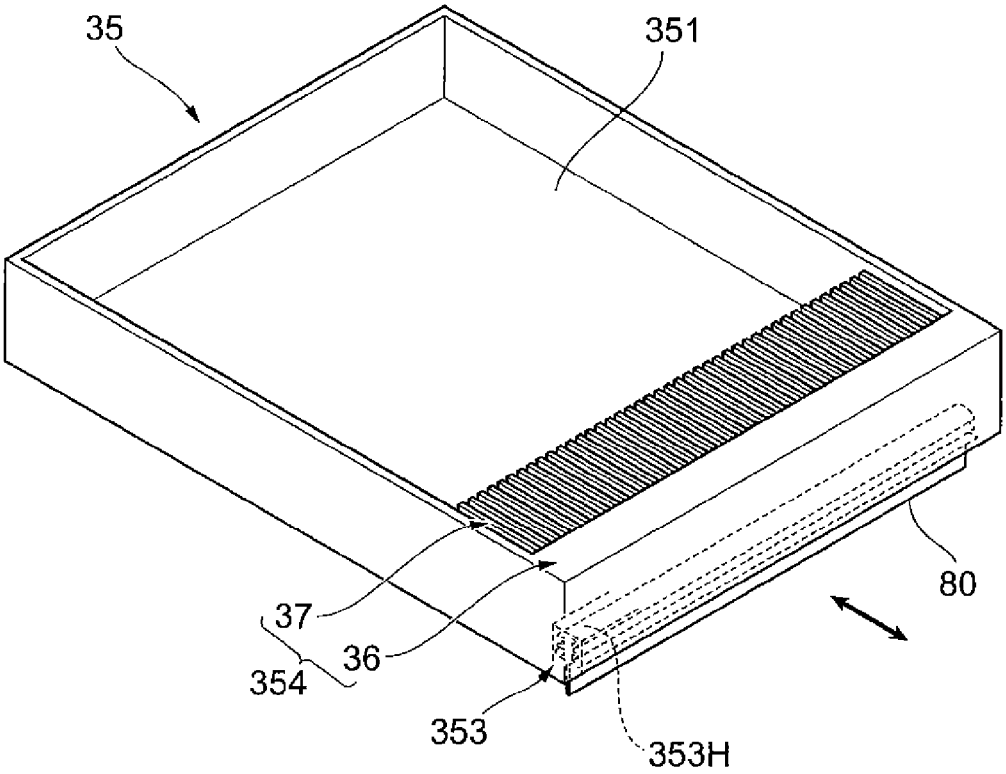
FIGS. 8A and 8B are views illustrating a contacted section of a drawing section in detail.
Figure 8B:
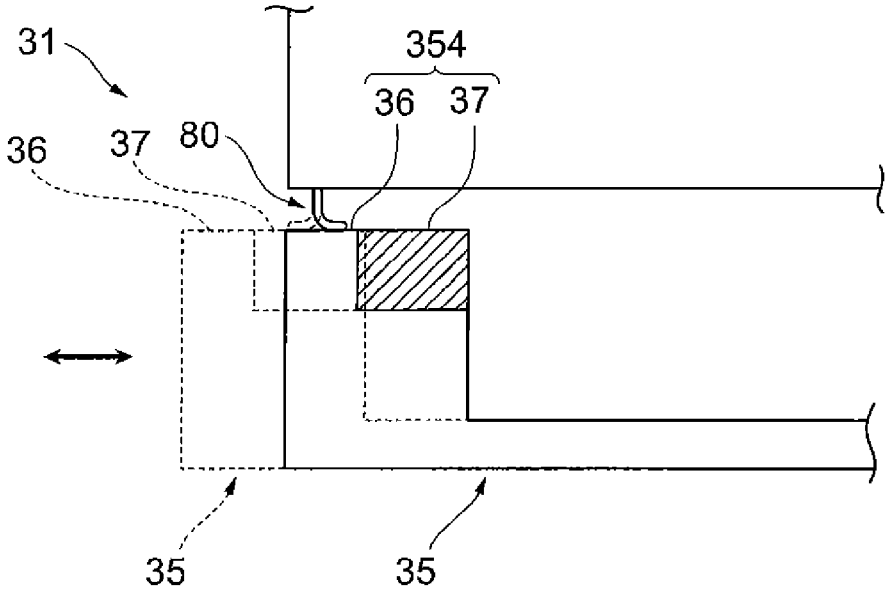

FIGS. 8A and 8B are views illustrating the contacted section 354 of the drawing section 35 in detail.

As illustrated in FIG. 8A, the contacted section 354 is configured to include a surface contact portion 36 as an example of a continuous contact portion formed in a planar shape and a rib contact portion 37 as an example of a partial contact portion formed of a plurality of ribs. Then, the contacted section 354 that is configured to include the surface contact portion 36 and the rib contact portion 37 comes into contact with the second gasket 80 when the drawing section 35 is opened and closed, and when the drawing section 35 is disposed in a predetermined position in which the sheet can be supplied inside the housing member 50B (see FIG. 1).

The surface contact portion 36 is a surface that is formed so as to continuously come into contact with the sealing section 82 when coming into contact with the second gasket 80. The surface contact portion 36 is provided to have a width corresponding to a length of a deformation portion of the rising section 821 in a state where the second gasket 80 comes into contact with the contacted section 354 in the drawing direction of the drawing section 35. Furthermore, the surface contact portion 36 is formed corresponding to a length of the second gasket 80 extending in one direction in a direction intersecting the drawing direction.

Then, as illustrated in FIG. 8B, the surface contact portion 36 is formed in a position facing the second gasket 80, in a state where the drawing section 35 is disposed inside the housing member 50B.

In the embodiment, the rib contact portion 37 is configured such that a plurality of upright planar members are arranged having predetermined intervals. Furthermore, the ribs configuring the rib contact portion 37 are disposed to extend along the drawing direction of the drawing section 35.

The rib contact portion 37 is formed having a predetermined width in the drawing direction of the drawing section 35. Moreover, in the embodiment, the width of the rib contact portion 37 in the drawing direction is set to be equal to or more than a thickness of the maximum number of the sheets in a bundle that can be stacked in the stacking member 351. Furthermore, the rib contact portion 37 is formed corresponding to a length of the second gasket 80 extending in one direction in a direction intersecting the drawing direction.

Furthermore, in the embodiment, a height of an upper end portion of the plurality of ribs configuring the rib contact portion 37 is aligned. Therefore, an imaginary plane passing through the upper end portion of the rib contact portion 37 is formed in the planar shape without irregularities. Thus, in the embodiment, the height of the upper end portion of the rib contact portion 37 is aligned with the height of the surface of the surface contact portion 36.

Then, as illustrated in FIG. 8B, the rib contact portion 37 is formed to face the second gasket 80 in a state where the drawing section 35 is positioned in a position deviated from the installation position by performing the opening and closing operation due to drawing and inserting rather than in a state where the drawing section 35 is installed inside the housing member 50B.

The contacted section 354 having such a configuration moves while coming into contact with the second gasket 80 in the rib contact portion 37, in a state where the drawing section 35 is drawn out or inserted. At this time, the sealing section 82 of the second gasket 80 partially comes into contact with the rib contact portion 37 over the longitudinal direction. Thus, noise caused by contact between the second gasket 80 and the contacted section 354 is reduced compared to a case where the sealing section 82 continuously comes into contact with the rib contact portion 37 over the longitudinal direction.

Furthermore, if the drawing section 35 is in a state of being installed on a predetermined position, the second gasket 80 comes into contact with the surface contact portion 36. In this state, the sealing section 82 of the second gasket 80 continuously comes into contact with the surface contact portion 36 over the longitudinal direction. The gap between the contacted section 354 and the second gasket 80 is sealed and noise leakage of the housing member 50B to the outside is reduced.

Thus, for example, regarding the contacted section 354 of the drawing section 35, if the contacted section 354 of the drawing section 35 is configured of only the surface contact portion 36 that is the contact surface in a state where the drawing section 35 is installed in a predetermined position, strength of the drawing section 35 may be insufficient. Thus, in the embodiment, sealing between the drawing section 35 and the second gasket 80 is also realized while maintaining the strength of the drawing section 35 by providing the rib contact portion 37 partially coming into contact with the second gasket 80 in the contacted section 354.

Furthermore, in the embodiment, the height of the upper end portion of the plurality of ribs configuring the rib contact portion 37 is set to be aligned with the height of the surface of the surface contact portion 36. For example, the contacted section 354 is exposed upward, in a state where the user draws the drawing section 35 out. Thus, the user may use the contacted section 354 to align the sheet bundle stacked in the stacking member 351 by the presence of the surface contact portion 36 and the rib contact portion 37. The user can align the irregularity of the sheet bundle and stacks the sheet bundle in the stacking member 351 by pressing the end portion of the sheet bundle to the surface contact portion 36 and the rib contact portion 37.

As the rib contact portion 37 of the contacted section 354, a planar member is employed in the embodiment, but the invention is not limited to the configuration. The rib contact portion 37 may have a shape that partially comes into contact with the second gasket 80 and, for example, may be a grid shape or a honeycomb shape.

Furthermore, in the embodiment, the second gasket 80 is provided on the lower side opposite to the stacking member 351 in each sheet storage section 31, but the second gasket 80 may be mounted on the side in which the stacking member 351 is provided. However, in the embodiment, operability is prevented from being lowered by disposing the second gasket 80 on the lower side of each drawing section 35 when stacking the sheets in the stacking member 351.

Furthermore, the gasket 70 of the embodiment may be mounted on the drawing section 35 described above. In this case, the sealing section 72 of the gasket 70 comes into contact with the facing contacted section 354 of the drawing section 35 and thereby performing the sealing of the gap.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sealing member that seals a gap between one member and the other member, comprising:

a mounting section that has a portion coming into contact with the other member;

an extension section that extends from a side of the mounting section to a side of the one member and is configured to approach the mounting section while coming into contact with the one member by receiving a force from the one member; and a recess that is provided between the mounting section and the extension section and is formed from a part of the mounting section to a part of the extension section, and is recessed from a surface of the mounting section on the side of the one member and a surface of the extension section on a side of the other member, wherein the recess is formed such that a cross-sectional shape thereof is an arc shape, a thickness of a portion where the recess is formed is thinner than a that of a potion of the extension section where the recess is not formed, and an intersecting point between a portion where the recess is formed and an imaginary extension line that is extended from an upper surface of the mounting section is located at a substantial center of an arc shape of the portion where the recess is formed.

2. The sealing member according to claim 1, wherein the recess formed in the part of the mounting section does not protrude to the side of the one member beyond a recess-starting portion from the surface of the mounting section.

3. An image forming apparatus comprising:

a housing member that has an image forming section forming an image and has an opening section in a given position;

an opening and closing member that is capable of opening and closing the opening section of the housing member; and a sealing member including a mounting section that has a portion coming into contact with one member of the opening and closing member or the housing member, an extension section that extends from a side of the mounting section to a side of the other member of the opening and closing member or the housing member and is configured to approach the mounting section while coming into contact with the other member by receiving a force from the other member, and a recess that is provided between the mounting section and the extension section and is formed from a part of the mounting section to a part of the extension section and is recessed from a surface of the mounting section on the side of the other member and a surface of the extension section on a side of the one member, wherein the recess is formed such that a cross-sectional shape thereof is an arc shape, and a thickness of a portion where the recess is formed is thinner than a that of a portion of the extension section where the recess is not formed.

4. The image forming apparatus according to claim 3, wherein the extension section does not come into contact with the mounting section in a state where the opening and closing member is closed.

5. The sealing member according to claim 3, wherein the recess formed in the part of the mounting section does not protrude to the side of the other member beyond a recess-starting portion from the surface of the mounting section.

6. A sealing member that seals a gap between one member and the other member which moves in one direction and the other direction opposite to the one direction relative to the one member, comprising:

a mounting section that has a shaft section inserted to the one member and a portion coming into contact with the one member; and an extension section of which a rigidity is lower than that of the mounting section and that extends from the mounting section linearly along an axial line of the shaft section in a state that the extension section is not in contact with the other member, and is configured to move with respect to the other member while coming into contact with the other member to approach the mounting section with being deformed in the one direction or the other direction in accordance with the relative movement.

7. The sealing member according to claim 6, wherein a hardness of the extension section is lower than that of the mounting section.

8. The sealing member according to claim 6, wherein the extension section is connected to the mounting section so as to be embedded into the mounting section.

9. The sealing member according to claim 6, wherein the mounting section includes:

a first protrusion section that protrudes at a given angle with respect to the shaft section; and a second protrusion section that is positioned in an end portion more than the first protrusion section in an axial direction of the shaft section and protrudes at an angle with respect to the shaft section larger than that of the first protrusion section.

10. An image forming apparatus comprising:

a housing member that has an image forming section forming an image;

a drawing member that is capable of operating in a drawing direction of drawing toward an outside of the housing member and in an insertion direction of inserting inside the housing member;

a facing member that is provided to face the drawing member; and a sealing member that seals a gap between the drawing member and the facing member, wherein the sealing member comprises:

a mounting section that has a shaft section inserted to one member of the drawing member or the facing member and a portion coming into contact with the one member; and an extension section of which a rigidity is lower than that of the mounting section and that extends from the mounting section along an axial line of the shaft section in a state that the extension section is not in contact with the other member of the drawing member or the facing member, and is configured to move with respect to the other member while coming into contact with the other member to approach the mounting section with being deformed in the drawing direction or the insertion direction in accordance with a relative movement of the drawing member and the facing member.

11. The image forming apparatus according to claim 10, wherein the mounting section includes:

a first protrusion section that protrudes at a given angle with respect to the shaft section; and a second protrusion section that is positioned in an end portion more than the first protrusion section in an axial direction of the shaft section and protrudes at an angle with respect to the shaft section larger than that of the first protrusion section.

12. The image forming apparatus according to claim 10, wherein the facing member or the drawing member has a holding groove for holding the mounting section of the sealing member, and the sealing member has an engaging section having a width longer than that of the holding groove and being engaged with the holding groove.

13. The image forming apparatus according to claim 12, wherein the engaging section is formed in a tapered shape of which an end portion of the engaging section is inclined toward the holding groove.

14. The image forming apparatus according to claim 12, wherein the holding groove is provided with a concave portion formed into which the engaging section is embedded.

15. An image forming apparatus comprising:

a housing member that has an image forming section forming an image;

a first drawing member that is capable of operating in a drawing direction of drawing toward an outside of the housing member and in an insertion direction of drawing inside the housing member;

a second drawing member that is provided below the first drawing member and is capable of operating in the drawing direction of drawing toward the outside of the housing member and in the insertion direction of inserting inside the housing member; and a sealing member that seals a gap between the first drawing member and the second drawing member, wherein the sealing member comprises:

a mounting section that has a shaft section inserted to one member of the first drawing member or the second drawing member and a portion coming into contact with the one member; and an extension section of which a rigidity is lower than that of the mounting section and that extends from the mounting section along an axial line of the shaft section in a state that the extension section is not in contact with the other member of the first drawing member or the second drawing member, and is configured to move with respect to the other member while coming into contact with the other member to approach the mounting section with being deformed in the drawing direction or the insertion direction in accordance with a relative movement of the first drawing member and the second drawing member.

16. The image forming apparatus according to claim 15, wherein the shaft section is inserted into the first drawing member.

17. An image forming apparatus comprising:

a housing member that has an image forming section forming an image;

a drawing member that is capable of operating between a drawing position at which the drawing member is drawn toward an outside of the housing member and an installation position at which the drawing member is installed in the housing member;

a facing member that is provided to face the drawing member;

a sealing member that is formed to extend in one direction intersecting a drawing direction of the drawing member and is provided in the drawing member or the facing member, and seals a gap between the drawing member and the facing member;

a continuous contact portion that is provided in the drawing member in accordance with a length of the sealing member in the one direction and continuously comes into contact with the sealing member in the one direction in a state where the drawing member is positioned in the installation position; and a partial contact portion that is provided in the drawing member in accordance with the length of the sealing member in the one direction and partially comes into contact with the sealing member in the one direction when the drawing member is positioned in a position deviated from the installation position to a side of the drawing position.

18. The image forming apparatus according to claim 17, wherein the drawing member has a sheet storage section that stores a sheet that is supplied to the image forming section, and wherein the partial contact portion is continuously disposed in the continuous contact portion and is formed so as to align a height position thereof with the continuous contact portion.

19. The image forming apparatus according to claim 17, wherein the partial contact portion is configured of a plurality of ribs extending along a drawing direction of the drawing member.

20. The image forming apparatus according to claim 17, wherein the partial contact portion is configured of a plurality of plate-shaped members extending along the drawing direction of the drawing member which is arranged at a given interval.

21. A storage member comprising:

a storage section that stores a stored member;

a drawing member that is capable of operating between a drawing position at which the storage section is drawn toward an outside of the housing member and an installation position at which the storage section is installed in the housing member;

a facing member that is provided to face the drawing member;

a sealing member that is formed to extend in one direction intersecting a drawing direction of the drawing member and is provided in the drawing member or the facing member, and seals a gap between the drawing member and the facing member;

a continuous contact portion that is provided in the drawing member in accordance with a length of the sealing member in the one direction and continuously comes into contact with the sealing member in the one direction in a state where the drawing member is positioned in the installation position; and a partial contact portion that is provided in the drawing member in accordance with the length of the sealing member in the one direction and partially comes into contact with the sealing member in the one direction when the drawing member is positioned in a position deviated from the installation position to a side of the drawing position.

22. The image forming apparatus according to claim 21, wherein the partial contact portion is configured of a plurality of plate-shaped members extending along the drawing direction of the drawing member which is arranged at a given interval.

* * * * *